US005476168A

United States Patent [19]

Malzard et al.

[11] Patent Number: 5,476,168

[45] Date of Patent: Dec. 19, 1995

[54] COIN VALIDATOR

[75] Inventors: Norman R. Malzard; Phillip A. Wolstencroft, both of New South Wales; Peter R. Smith, Victoria, all of Australia

[73] Assignee: Microsystem Controls Pty Ltd, Australia

[21] Appl. No.: 961,893

[22] PCT Filed: Jul. 4, 1991

[86] PCT No.: PCT/AU91/00295

§ 371 Date: Feb. 22, 1993

§ 102(e) Date: Feb. 22, 1993

[87] PCT Pub. No.: WO92/01270

PCT Pub. Date: Jan. 23, 1992

[30] Foreign Application Priority Data

Jul. 5, 1990 [AU] Australia ..... PK1057

[51] Int. Cl.[6] ..... G07D 5/08

[52] U.S. Cl. ..... 194/203; 194/318

[58] Field of Search ..... 194/317, 318, 194/319, 344, 347, 203

[56] References Cited

U.S. PATENT DOCUMENTS

| | | | |
|---|---|---|---|
| 2,014,505 | 9/1935 | Patche | 194/347 X |
| 3,837,454 | 9/1974 | Joeck . | |
| 3,870,137 | 3/1975 | Fougere . | |
| 3,918,565 | 11/1975 | Fougere . | |
| 3,998,309 | 12/1976 | Mandas et al. | 194/203 |
| 4,254,857 | 3/1981 | Levasseur et al. | 194/319 |
| 4,410,077 | 10/1983 | Okolischan . | |
| 5,020,653 | 6/1991 | Shimizh | 194/317 |

FOREIGN PATENT DOCUMENTS

| | | |
|---|---|---|
| 24242/84 | 2/1984 | Australia . |
| 119000 | 9/1984 | European Pat. Off. . |
| 300781 | 1/1989 | European Pat. Off. . |
| 1321241 | 6/1973 | United Kingdom . |
| 1397083 | 6/1975 | United Kingdom . |
| 1452740 | 10/1976 | United Kingdom . |
| 1527450 | 10/1978 | United Kingdom . |
| 2041532 | 9/1980 | United Kingdom . |
| 2135492 | 8/1984 | United Kingdom . |
| 2234620 | 2/1991 | United Kingdom . |

*Primary Examiner*—F. J. Bartuska
*Attorney, Agent, or Firm*—Reed Smith Shaw & McClay

[57] ABSTRACT

A coin validator (10) has a coin path (26) which passes between one set of detect coils (40, 42). The set of coils (40, 42) is connected in a detect circuit, and the coils (40, 42) are adapted to be energized with a single pulse. The decay curve (70) of the voltage in the coils (40, 42) is processed to produce a set of three numbers of clock counts defining each coin, which are stored in a microprocessor. Preprogramming of the validator (10) involves generating sets of numbers for representatives of a coin type to create three ranges of numbers, within which respective range a subsequent coin's set of numbers must fall in order for it to be defined as an example of the coin type. The coin path (26) is arranged at an angle to the vertical, and the base (32) is arranged at an angle to the horizontal such that the angle between one wall (36) and the base (32) is between 90° and 180°, causing coins passing along the coin path (26) to orient themselves such that each of them has point contact on the base (32) and on one wall (36), thereby occupying a generally similar position with respect to the coils (40, 42).

20 Claims, 16 Drawing Sheets

COIN VALIDATOR

FIELD OF THE INVENTION

This invention relates to a method and apparatus for validating or discriminating between coins, tokens or similar articles.

BACKGROUND OF THE INVENTION

Coin-operated apparatus are being increasingly used throughout the world to provide goods and services. Such apparatus includes amusement machines, vending machines for a wide variety of products, gaming machines (such as "poker machines") and payphones.

As a sub-group, vending machines dispensing such varied products as public transport tickets, confectionery, video cassettes and breadsticks are increasingly apparent in developed countries due to the high cost of labour and a demand for twenty-four-hour access to such products.

In addition, public telephones or payphones are becoming more sophisticated. Although there is a trend towards payphones which operate only on a "phone card" or credit card, it is likely that future payphones will be modelled on those currently in use in Italy, in which one may use coins, phone cards or gettoni (telephone tokens).

Although there are in use banknote validators, the problems inherent in "reading" banknotes (particularly mutilated or worn banknotes) coupled with the trend in most countries to replace lower denomination banknotes with coins, means that in all of the abovementioned applications, a coin validator will be required.

To be acceptable in one of the abovementioned applications, a coin validator must quickly and accurately discriminate between coins of different values, between coins of different countries and between genuine coins and bogus coins. Existing coin validators have been unable to discriminate adequately, in some cases, between a low value coin of a foreign country and a higher-value coin of the country in which the validator is located. Particularly in a region such as Europe, coin validators additionally cannot cope with the large number of migratory coins from various European countries.

One example of a prior art coin validator is provided by U.S. Pat. No. A-3,918,565, which discloses coin selection methods and apparatus in which data representative of a coin is compared with data store in a programmable memory.

In U.S. Pat. No. A-3,918,565, a numerical value of a signal produced by interrogating a coin, such as frequency, is compared with acceptable numerical values for genuine coins which are stored in the programmable memory.

Another prior art coin validator is disclosed in AU-B-24242/84, which discloses the use of pulsing coils which induce eddy currents in a coin. Monitoring means is used to monitor the decay of the eddy currents, and a comparison between the output of the monitoring means and stored reference values enable discrimination to take place.

It is considered that the approach of AU-B-24242/84 is unnecessarily complicated, and would not permit an adequately rapid discrimination to take place.

DESCRIPTION OF THE INVENTION

The invention in one embodiment provides a method for validating coin/token including the steps of:

energising detect coils, between which at least part of a coin/token is located, with a single pulse, extracting from at least one portion of the back EMF curve of the decaying pulse information to provide a definition of said coin/token, said or each portion of said back EMF curve being inverted and amplified, and comparing in a microprocessor said definition of said coin/token with a reference definition, to determine whether said coin/token is acceptable or unacceptable, said definition being in the form of a period of time, or a number of system clock counts, which counts represent a period of time, and wherein said period of time or said number relates to the time between a predetermined time, in relation to the de-energisation of said coils, and the intersection of said back EMF with a reference voltage curve.

The invention in another embodiment also provides a method of validating a coin/token, including the steps of:

energising detect coils, between which at least part of a coin/token is located at the time of energisation;

de-energising said coils after a predetermined time;

inverting and amplifying at least one portion of a voltage-limited back EMF curve, or a curve of the decaying voltage in said coils;

obtaining a first number of system clock counts from the time between de-energisation of said coils and that when the curve intersects a first reference voltage;

obtaining a second number of system clock counts from the time between de-energisation of said coils and that when the curve intersects a second reference voltage;

obtaining a third number of system clock counts from the time between de-energisation of said coils and that when the curve intersects a third reference voltage;

comparing said first number, said second number and said third number respectively with a first range of stored numbers, a second range of stored numbers and a third range of stored number; and producing a signal representative of the acceptance of said coin/token if said first number, said second number and said third number fall respectively within said first range, said second range and said third range of numbers.

The invention in another embodiment further provides a method of programming a coin/token validator to store reference values for one type of coin/token, including the steps of:

energising detect coils, between which at least part of a first coin/token of a first type is located at the time of energisation with a single pulse; and extracting from the back EMF of the decaying pulse information in the form of a first set of numbers, which set constitutes a definition of said first coin/token;

storing said first set of numbers;

repeating said first and second steps for a predetermined number of coins/tokens of a first type, and storing each set of numbers produced by said steps with said first set of numbers, to produce a set of ranges of numbers; and establishing the set of stored ranges of numbers obtained for all the coins/tokens of said first type, with or without expansion at one or both ends of one or more of said ranges, as a set of ranges of numbers representative of said first type of coin/token.

The invention also provides a coin/token validator including:

a reference path;

detect coils located either side of said path;

detect means to detect the presence of at least part of a coin/token between said coils;

means to energise and de-energise said coils with a single pulse;

means to derive a definition of said coin/token from the period of energisation, said definition being constituted by a number, or by a set of numbers, of system clock counts, derived from portions of the post de-energisation decay curve of the voltage in said detect coils.

The invention further provides a coin/token path for a coin/token validator, said coin/token path being defined in part by a first side wall, and a second side wall, and a base, each of said first side wall and said second side wall being, in use, oriented at an angle to the vertical such that a coin/token passing along said path will tend, under the influence of gravity, towards said second side wall and away from said first side wall, said base and said second side wall forming an angle of more than 90° but less than 180°, and said base, in use, being at an angle to the vertical, such that successive coins/tokens passing along said path will adopt a generally similar orientation relative to said base and said second side wall.

DESCRIPTION OF THE DRAWINGS

Embodiments of the invention will be illustrated in detail hereinafter, with reference to the accompanying drawings, in which.

DESCRIPTION OF THE PRESENTLY PREFERRED EMBODIMENTS

Reference will initially be made to FIGS. 1 to 10, which relate to the "hardware" aspect of the preferred embodiment.

The preferred coin validator is a self-contained unit locatable in a particular apparatus, such that a coin introduced into the apparatus—whatever the apparatus may be—will travel along a coin rolling path in the validator, will be validated or invalidated, and as a consequence will emerge from one outlet or another outlet of the validator, and the appropriate signal will be sent to the particular apparatus for further action.

Figure 1:
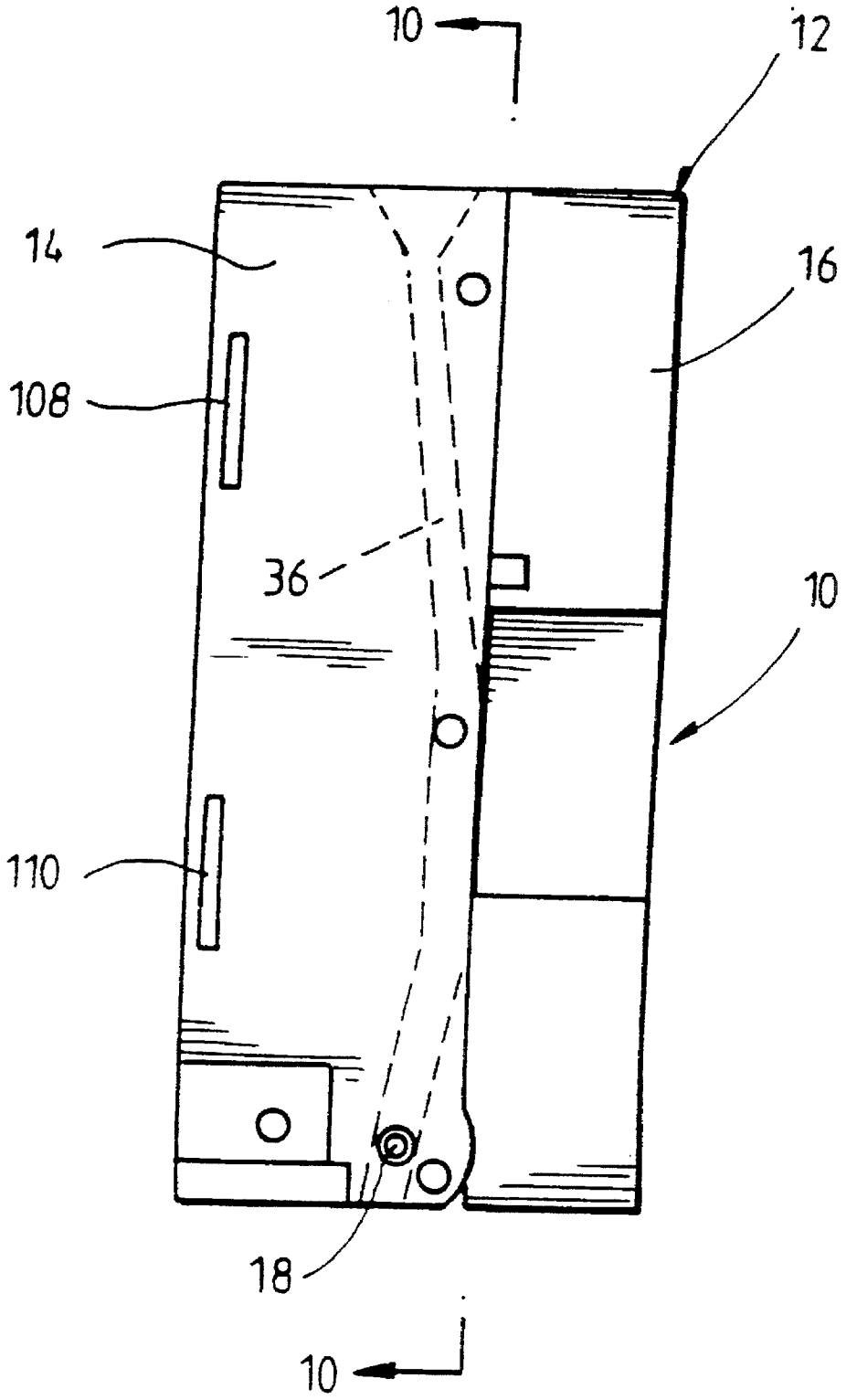
FIG. 1 is an end elevation of an elevation of an embodiment of a coin validator body according to the invention.
Figure 2:
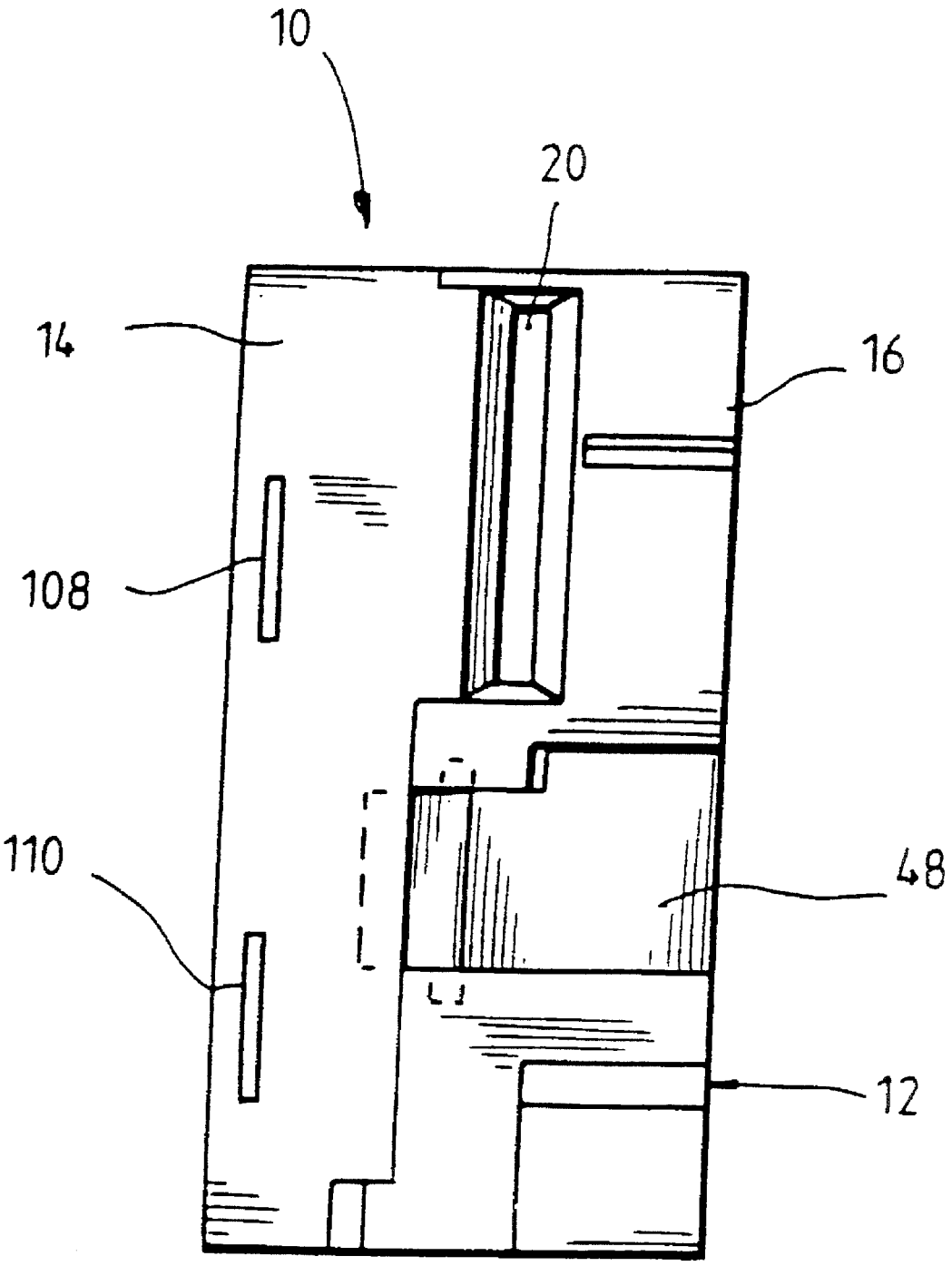
FIG. 2 is a top plan view of the coin validator of FIG. 1.
Figure 3:
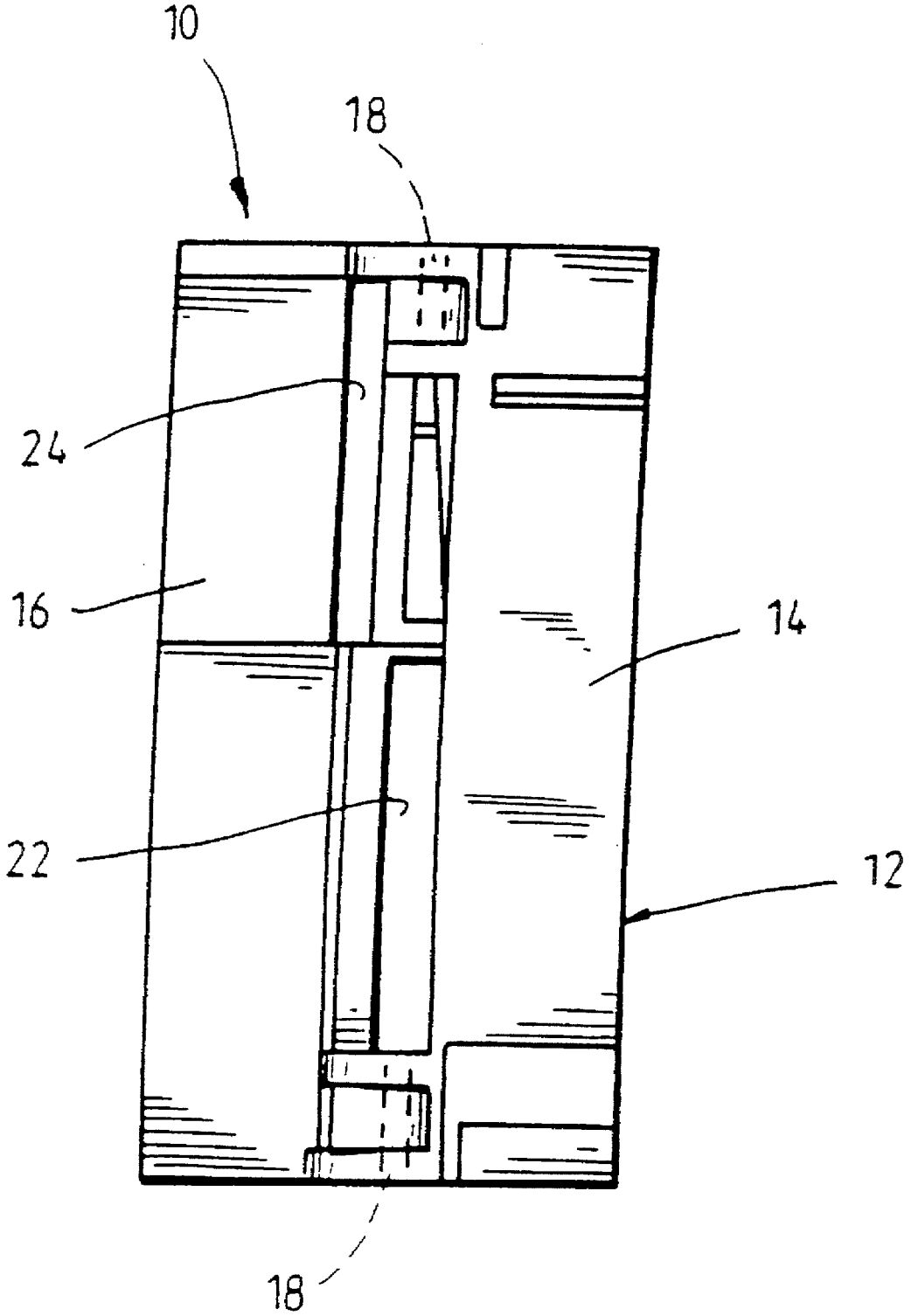
FIG. 3 is an underneath view of the coin validator of FIG. 1.

Referring firstly to FIGS. 1 to 3, the coin validator 10 of the preferred embodiment includes a body 12 which has two body portions 14 (main body) and 16 (subsidiary body), which are hinged together, as shown at 18.

Figure 5:
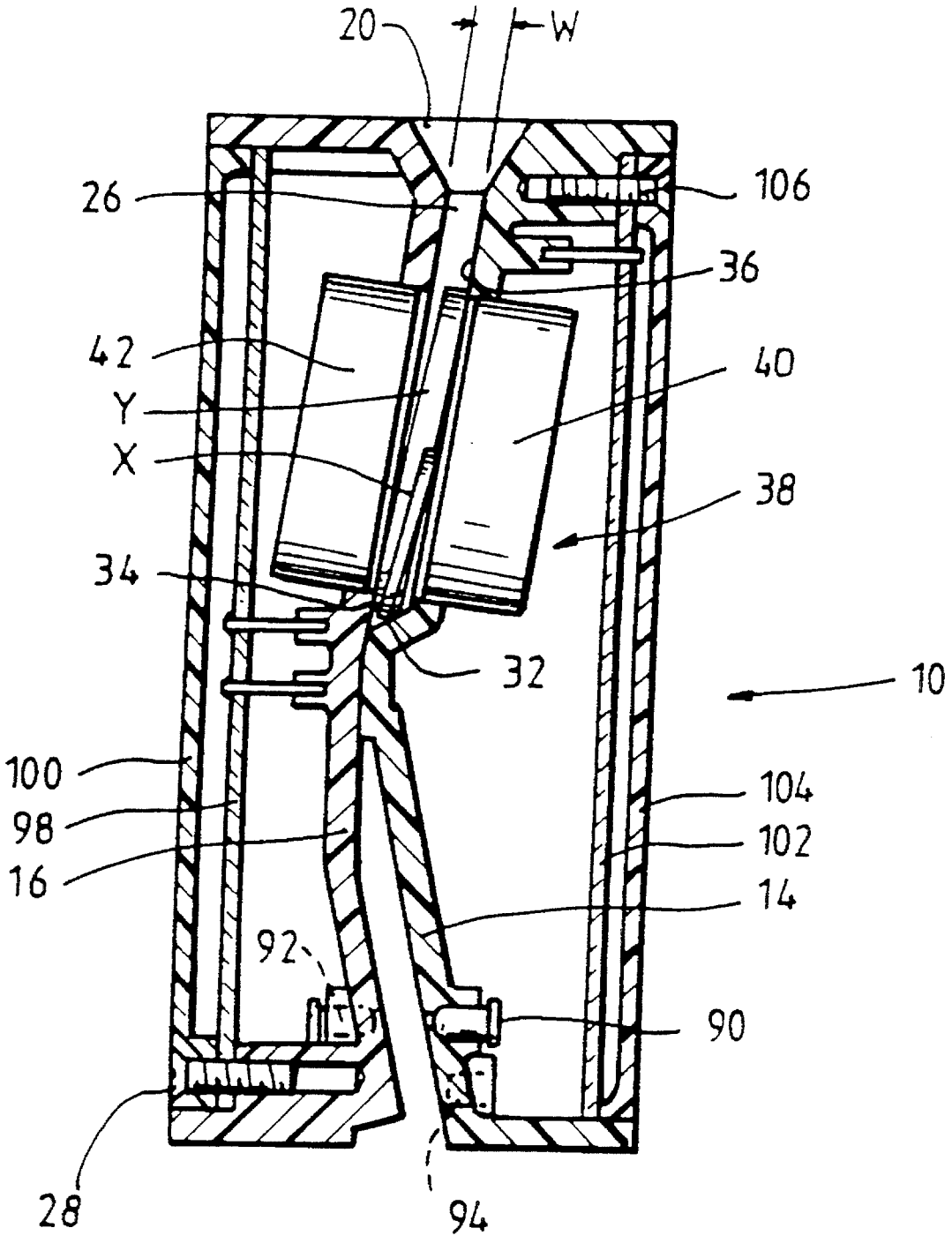
FIG. 5 is a section along the lines 5—5 of FIG. 4.

Within subsidiary body portion 16 there is a printed circuit board assembly 98, and a cover 100 is secured to body portion 16 by screws or the like, one of which is shown at 28 in FIG. 5.

Main body portion 14 has a printed circuit board assembly 102 located therein, and a cover 104 is secured to body portion 14 by screws or the like, one of which is shown at 106 in FIG. 5.

On printed circuit board assemblies 98,102 may be located all the electrical and electronic components to operate, monitor and control the validator 10.

Main body cover 104 may preferably be adapted to hook into slots (108,110) on main body portion 14, and as stated before may be secured via screws such as 106.

To secure validator 10 to or in apparatus such as a vending machine, pins 112,116,118 may be used to attach the validator 10 to bracketry (not shown) in the apparatus.

The upper view of the generally cuboidal body 12 (FIG. 2) shows a coin entrance 20, and the underneath view (FIG. 3) shows an 'accept' outlet 22 and a 'reject' outlet 24.

Figure 4:
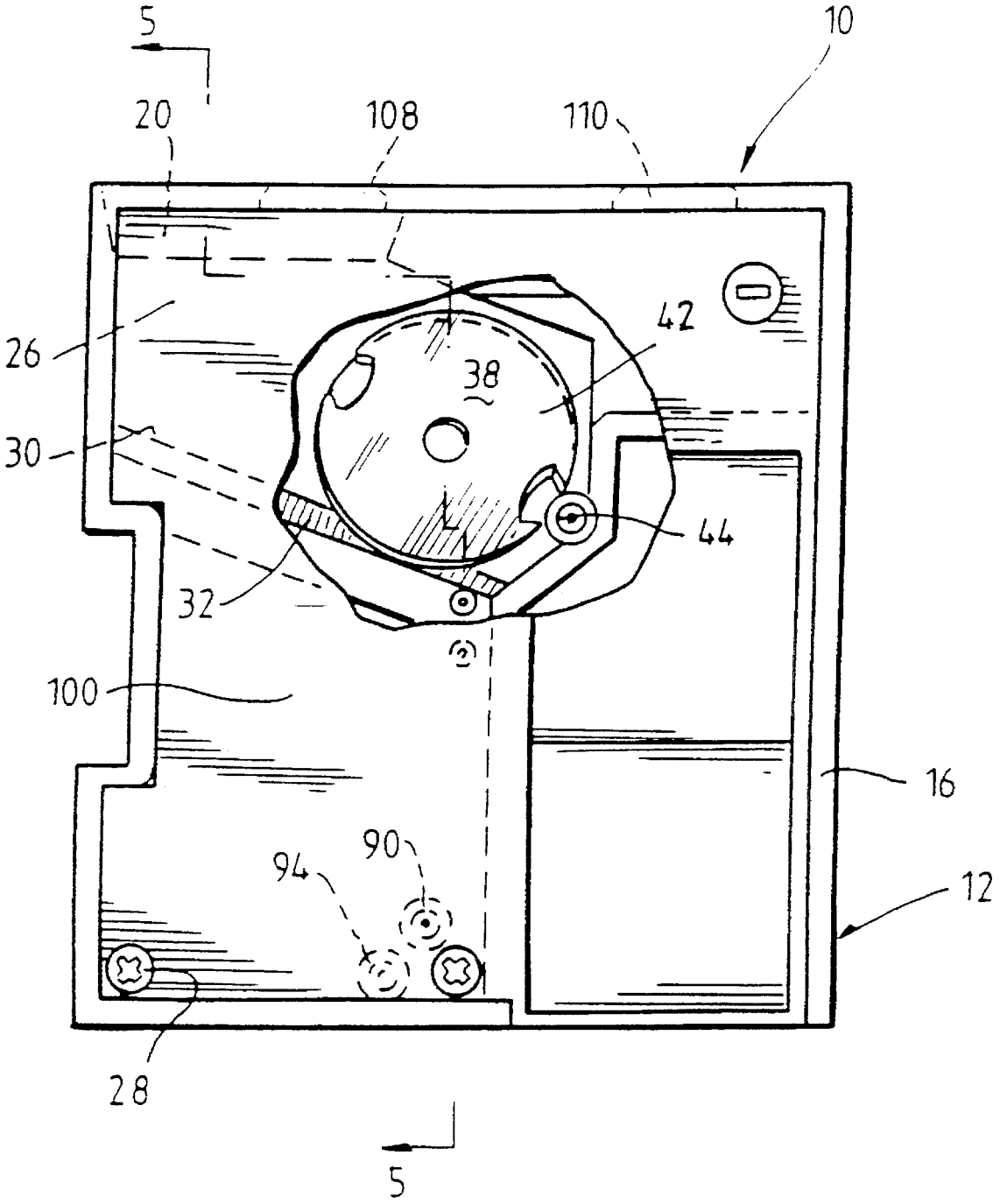
FIG. 4 is an elevation of a subsidiary body element of the body of FIG. 1.
Figure 6:
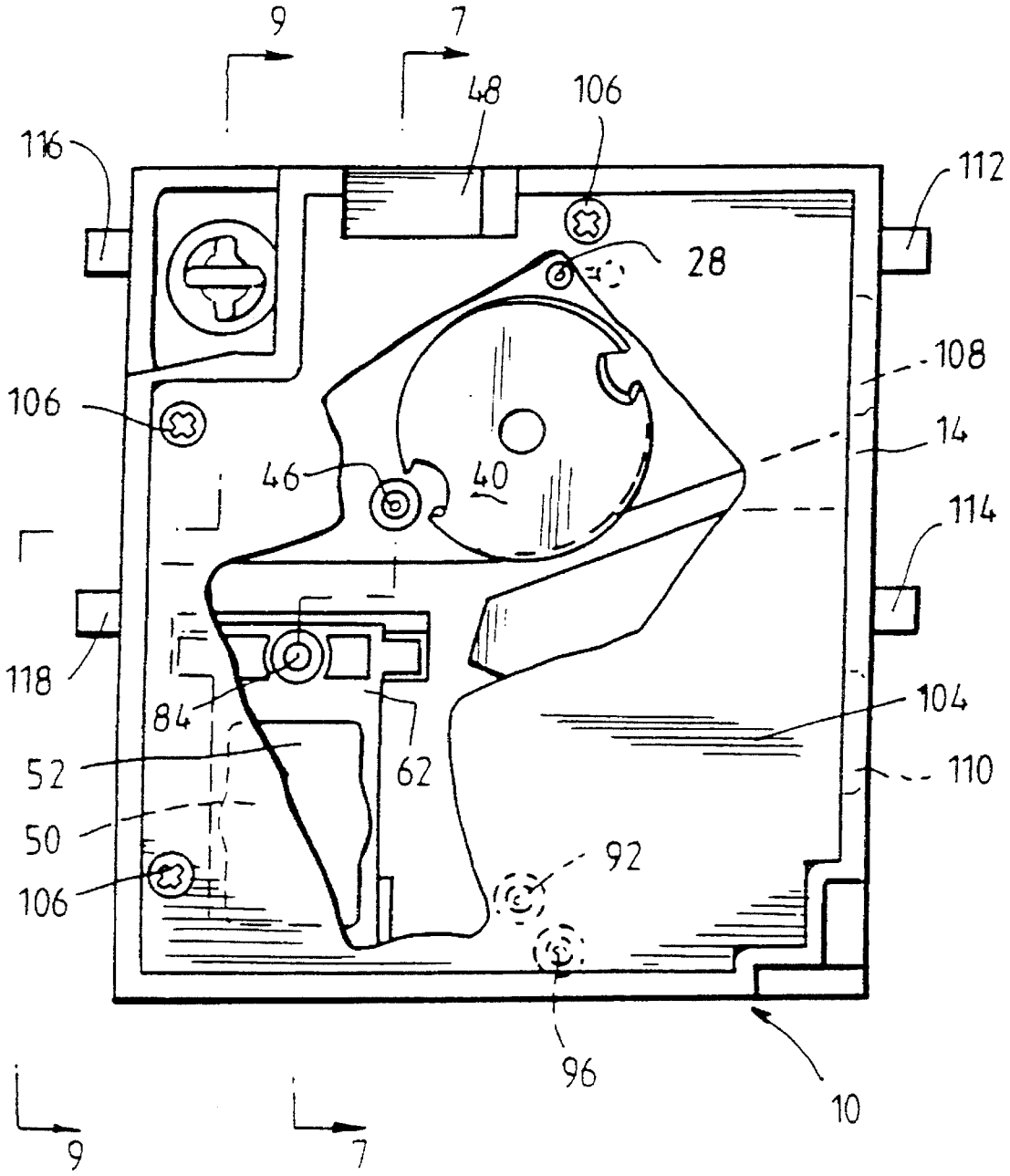
FIG. 6 is an elevation of a main body element of the body of FIG. 1.

Turning now to FIG. 4, 5 and 6, in particular FIG. 5, a coin path 26 extends from inlet 20. The width W of the coin path is selected to be the minimum consistent with the thickness of the coins likely to be introduced into the validator 10; in the preferred embodiment for use in Australia, the width W is 3.5 mm, as the thickest Australian coin—the two-dollar coin—is 3 mm thick.

A first optical sensor 28 is located close to the start of coin path 26, the first part of which 30 is a downwardly inclined (FIGS. 4,5) and is angled from the vertical (FIG. 5).

In prior art validators coin paths have been proposed, which seek to orient a coin, rolling past detectors, against one wall of the path or channel.

An example of such prior art is GB-A-2 182 477. In FIG. 2 of that document, a coin 'canal' 10 is shown, where the canal wall against which the coin 11 is sought to be oriented (the left-hand wall of FIG. 2) makes an acute angle with the base of the canal 10. Both the wall in question and the base, are at an angle to the vertical.

Thus, under the influence of gravity, the theory of an arrangement such as that of FIG. 2 of GB-A-2 182 477 is that the coin will orient itself flat against the wall in question, being urged to do so by gravity because the wall is on the 'down' side of the coin, and because the lower portion of the coin 11 will move down the base to the position shown.

In practice, the arrangement often does not work. Coins rattle through the canal, and the portions shown in FIG. 2 of GB-A-2 182 477 (between the coils 12,13) is not reproducible in a succession of coins passing through the canal.

By way of contrast as shown in FIG. 5, the base 32 of the coin path portion 30 of the embodiment of the present invention has an inclination opposite to that of the prior art, relative to side wall 36, in contact with which it is intended that a coin such as X or Y be, as the coin passes through detect area 38.

As a coin (for example small coin X shown in FIG. 5) is dropped into outlet 20, it will fall to portion 30. Under the influence of gravity, it will roll down the incline of portion 30, but the lower periphery of the coin will also slide down the lateral inclination of the base 32, such that that part of a lower peripheral edge of the coin will make point contact on base 32, and will locate between the lower end of base 32 and the lower end of side wall 34. This causes the coin, again under the influence of gravity, to fall to the position shown in FIG. 5, where the top peripheral edges makes a point contact with side wall 36 of coin path 26.

With the arrangement of FIG. 5, successive coins passing through area 38 on coin path 26, will each adopt an orientation where point contact will be made between a peripheral edge and wall 36, and a peripheral edge and base 32. This orientation is more stable than the prior art orientation, and is thus more reproducible in successive coins passing through region 38.

Coin Y, being a larger-diameter coin, will have a slightly different rest angle to that of coin X, but the angle is substantially the same for all coins. Thus the coin path 26 provides accurate validation of coins/tokens independently of the diameter of the coin/token, compare coins X and Y in FIG. 5. This has been found to assist in accurate validation, in that in the prior art coin paths as has been described, different coins may adopt different orientations at the area 38 of interrogation (to be described hereinafter) through rattling or wobbling as they pass the area, or as a result of the coins being wet or sticky, which leads to a reduction in accurate discrimination. In the illustrated embodiment, that aspect of discrimination has been minimised, because each coin passes the area 38 on a 'point contact' basis, with the substantially similar rest angle against wall 36, and thus in relation to coils 40,42 (described hereinafter).

Located on respective sides of coin path 26 at area 38 is one set of inductive (pot) coils 40,42. Coils 40,42 are connected in a detect circuit (such as, for example, the circuit of FIG. 11) and form a singular inductive field. The coils (40,42) are adapted to be energised with a single pulse, for each coin validation operation, by a generally conventional switching circuit (not shown).

The coils 40,42 are physically connected to respective body portions 14,16, preferably with an adhesive. From FIG. 5 it can be seen that the coils 40,42 are located generally parallel to the plane of coin path 26, and as near as practicable are separated by about the coin path width W.

Figure 7:
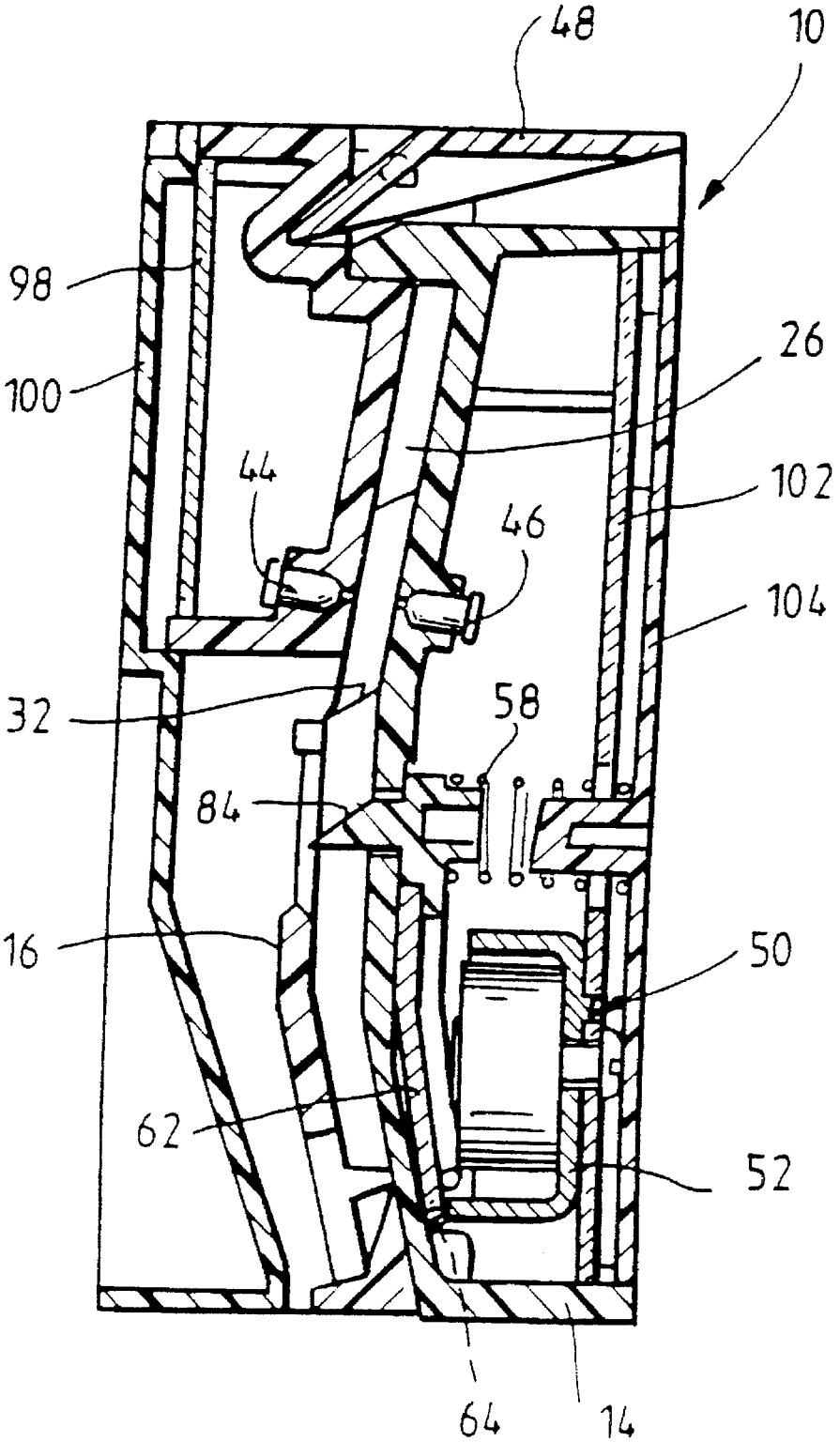
FIG. 7 is a section along the lines 7—7 of FIG. 6.

Located just adjacent to coils 40,42 in a position on the edge of the detect area 38, is a pair of optical sensors 44,46 (FIGS. 4, 6 and 7).

In FIG. 7 there is also shown a reject lever 48, which may be pushed down to release a jammed coin entering coin path 26.

Figure 8:
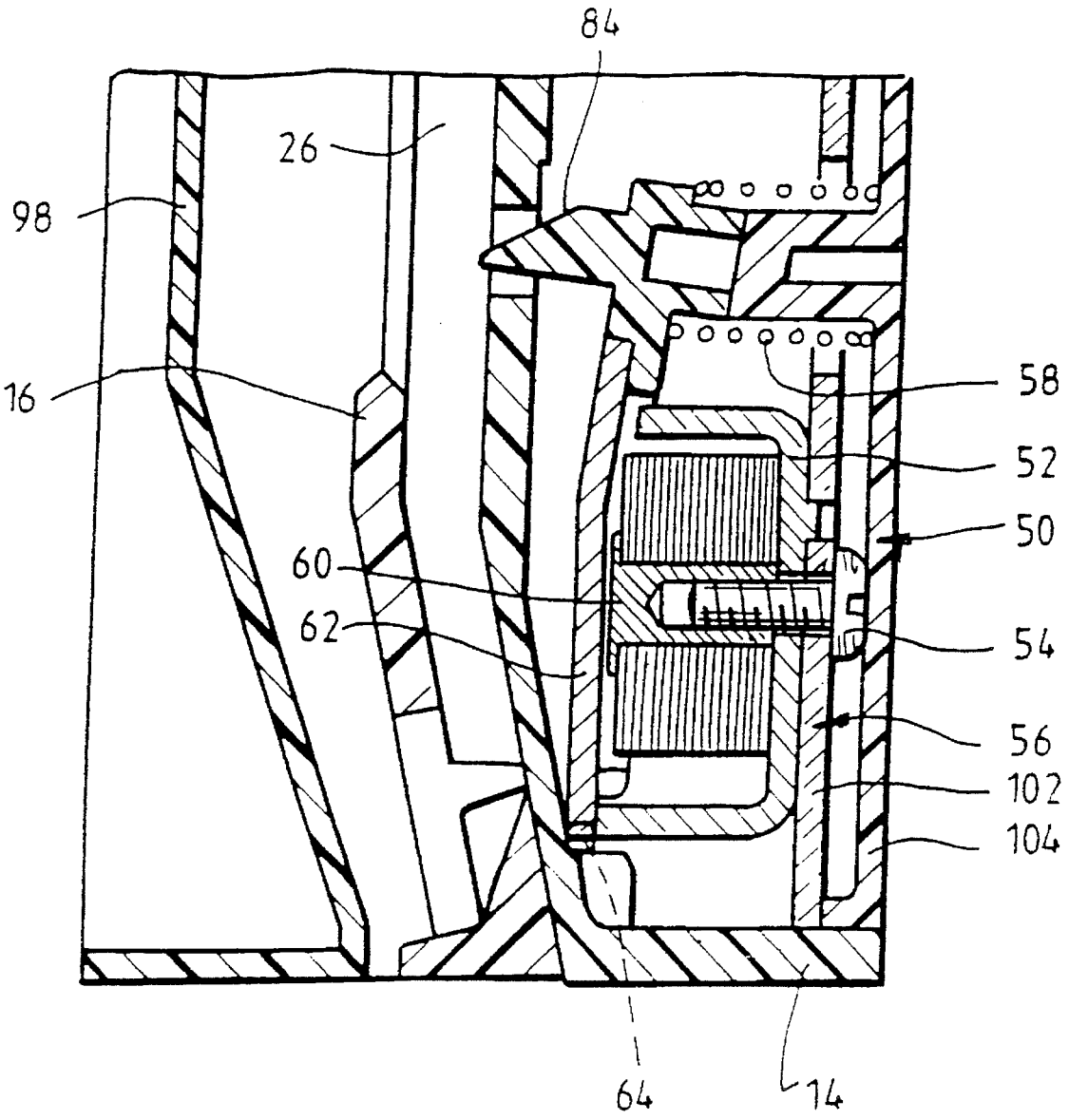
FIG. 8 is an enlarged view of part of FIG. 7.

Located at the base of body portion 14 is a coin accept/reject mechanism 50, shown in more detail in FIG. 8.

The mechanism 50 provides a fast acting means for allowing an accepted, that is, a validated coin to move into an 'accept' channel, whilst preventing a rejected coin from passing into the accept channel. The rejected coin is diverted into a 'reject' channel.

The mechanism 50 includes an accept/reject arm 62 which is pivoted on a 'floating' pivot 64, to be activated by a solenoid which has a U-shaped electro magnet 52 secured to body portion 14 by a screw or the like 54. The floating pivot 64 is adapted for limited movement, for example, it may be located in a groove in portion 14, to facilitate rapid movement of arm 62 between positions.

Arm 62 is normally held by spring means 58 in the 'reject' position shown in FIG. 7, where surface 84 of the arm 62 constitutes a continuation of base 32 of coin path 26.

When the mechanism is provided with an 'accept' signal, instruction or the like, the solenoid is energised. This causes arm 62 to be attracted to magnet 52. In particular, pivot 64 is attracted to the lower portion of magnet 52, eventually making contact therewith. At that stage the magnet 52/arm 62 combination enables more magnetic flux to be generated, and thus more magnetic force is applied to arm 62, to move it more quickly to the FIG. 8 position. It has been found that such an arrangement as the one shown in FIG. 8 enables extremely rapid retraction of arm 62.

The paths of both accepted and rejected coins will now be described in relation to FIGS. 1 to 10; they are best represented visually in FIG. 10.

Figure 9:
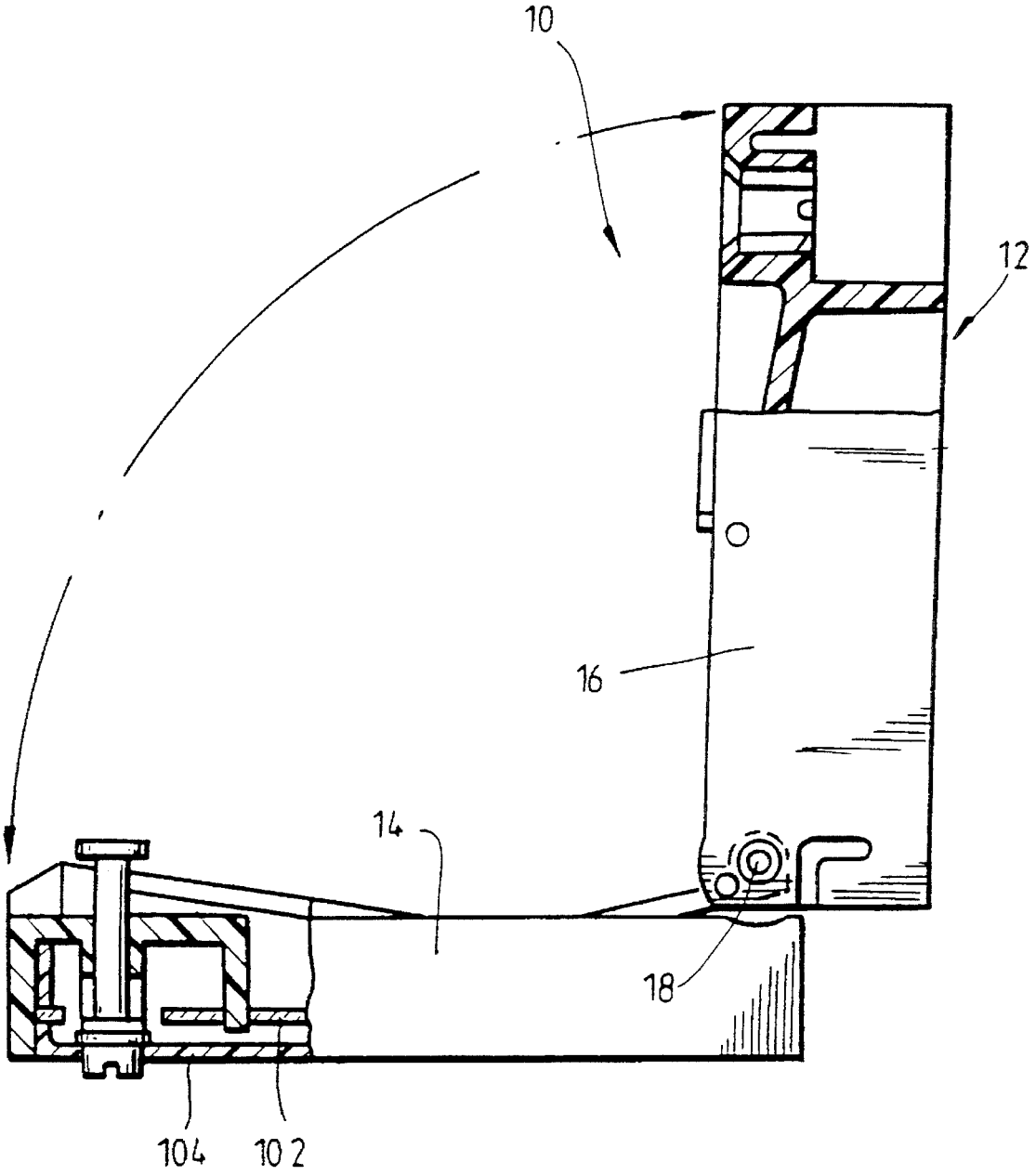
FIG. 9 is a section along the lines 9—9 of FIG. 6.

FIG. 9 shows the body 12 of validator 10 in its open configuration, where body portions 14,16 have been pivoted apart at pivot point 18. Pivot point 18 is preferably constituted by two hinge pins located at either end of the body 12, generally on the line of the coin path 26.

In a preferment, the body portions 14,16 and covers 98,102 are produced from a plastics material by injection moulding, and more preferably the coin path 26 is defined by internal mouldings of the portions. Thus, the one 'wall' of the coin path 26 is formed on one portion, and the other 'wall' on the other portion.

The hinged body arrangement, best shown in FIG. 9, enables the two portions 14,16 to be pivoted apart—in a preferred arrangement, the two portions are biased together, by spring means or the like—in order that the coin path 26 may be cleaned. Coin paths in validators often become dirty and/or clogged, due to residues carried by coins which pass therethrough.

Furthermore, the portions 14 and 16 may be pivoted apart in order that bent coins or slugs stuck in the device are able to drop free into the reject path.

The covers 98,102 fitted to body portions 14,16 also provide splash and dirt protection for the electronic components.

Figure 10:
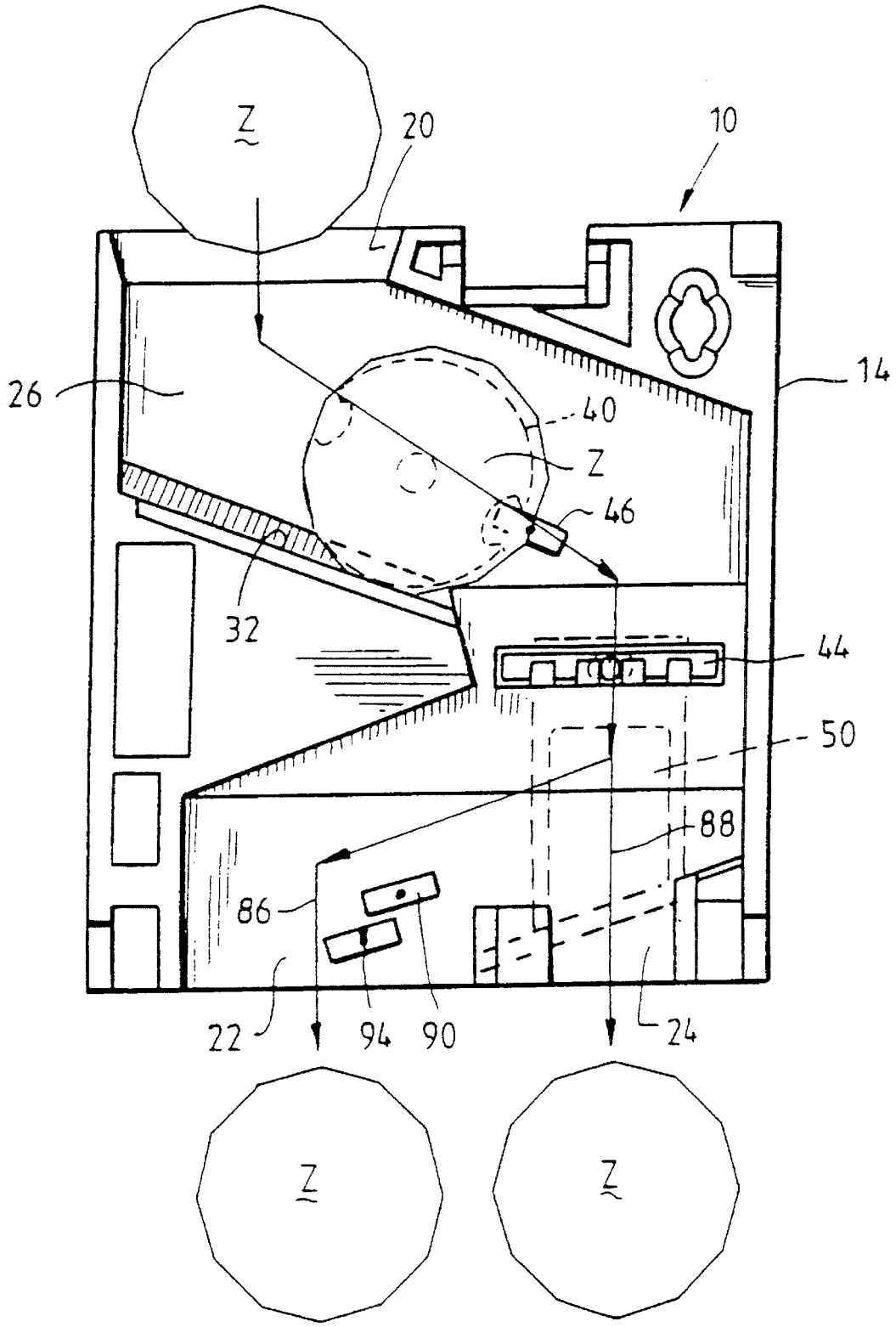
FIG. 10 is a section along the lines 10—10 of FIG. 1.

A coin Z—in the representation of FIG. 10, an Australian fifty-cent coin—enters validator 10 through inlet 20. There may be, in use, a coin channel leading from outside a vending machine, for example, to inlet 20, through which the coin Z may initially have to pass.

When the coin Z reaches the position shown, in which it is between coils 40 and 42 (see also FIG. 5, where coins X, Y are shown in that position) the presence of coin Z will be detected by optical sensors 44,46.

A 'coin detected' signal from sensors 44,46 is sent to a microprocessor (not shown) which causes coils 40,42 to be energised with a single pulse. After analysing the results of that energisation or pulse—one preferred method of which will be described hereinafter—the microprocessor either sends or does not send an 'accept' signal to mechanism 50.

If an 'accept' signal is sent to mechanism 50, the solenoid will be energised, arm 62 will be retracted, and coin Z will pass along the 'accept' channel, marked by the arrowed line 86.

If the analysis rejects the coin, arm 62 will stay in the 'reject' position and coin Z will be deflected by surface 84 of arm 62 into the 'reject' channel shown by arrowed line 88.

It should be understood that coin Z is moving all the time through validator 10. The analysis and decision making of the electronics associated with the validator 10 ensure that arm 62 is retracted or not, well before coin Z reaches mechanism 50.

Two further pairs of optical sensors are provided. They are check optical sensors 90,92 and accept optical sensors, 94,96.

If coin Z is accepted, and keeps moving down the accept channel, it will first pass between check sensors 90,92. Both the check and accept optical sensors are continuously monitored by the aforementioned microprocessor so as to ascertain the direction of movement of a coin within the validator 10. If the passage of the coin Z is such so as to trigger the accept optical sensors (90,92) before triggering the check optical sensors (94,96) then the passage of the coin Z is considered to be fraudulent and an alarm signal is generated or alternatively no outputs will be generated. This applies in cases where a coin on a piece of string or twine or other device is pulled in and out of the validator in an attempt to create fake credits.

The coin continues down the accept path until it reaches the accept optical sensors (92). Upon triggering the accept optical sensor the microprocessor considers that the coin Z has successfully travelled through the device and will give the appropriate outputs.

The use of the sensors (90,92,94,96) and the method of processing the information therefrom results in the validator having an "anti-cheat" element.

In use, the accept channel will lead to a coin bin or box, whilst the reject channel will lead to a location where the user can retrieve the rejected coin, token, waster, slug or the like.

When a coin is accepted, the validator 10 will send a signal to the apparatus in which it is located, representative of the value of the approved coin, and that value, or a cumulative total of a number of coins, may be displayed on display means.

Figure 11:
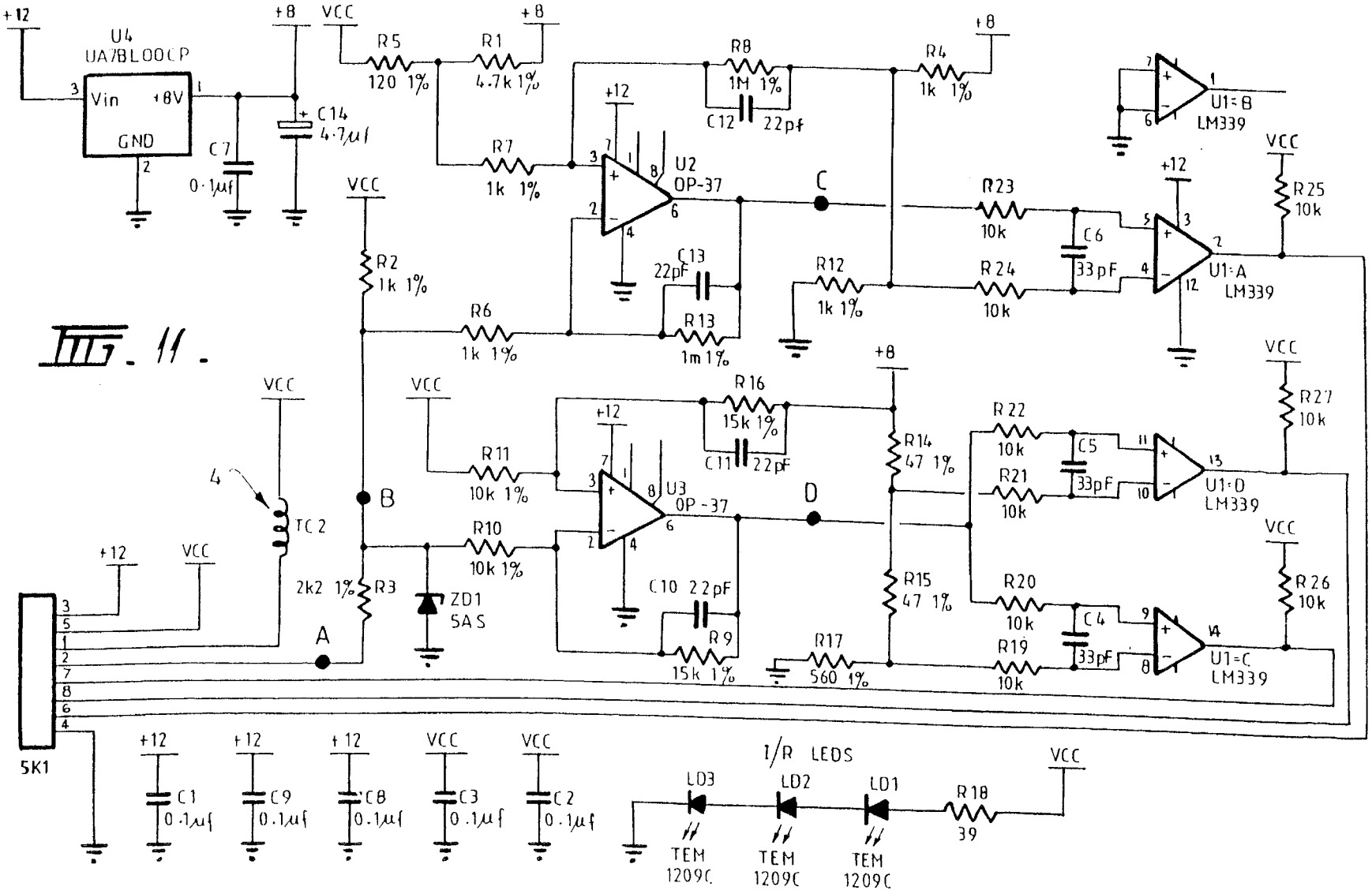
FIG. 11 is a circuit diagram of part of the circuit of an embodiment of coin validation/discrimination apparatus.

An embodiment of a coin validation/discrimination method, making use of the validator 10 of FIGS. 1 to 10, will now be described. FIG. 11 is a circuit diagram of part of the circuit which may be associated with validator 10. It should again be mentioned that the validator 10 contains a microprocessor which controls the validator, and which is able to be programmed by the connection of an unintelligent terminal—for example containing only a key pad and a display—in order to program or reprogram the validator 10.

Such programming may be carried out using, preferably, a hand-held device (not shown) which is adapted to be connected to the validator to set all functions (coin value, activate, de-activate) as well as enabling programming for other coins.

When used for programming, the hand-held device is used to set the main discriminating device to program mode.

FIGS. 12 to 16 are various curves which illustrate the steps to validation, using the validator of FIGS. 1 to 11.

Initially, in a programming mode, certain numerical values are obtained from the passage of a coin through the validator, and stored in the microprocessor, for subsequent reference and comparison in an 'in use' mode.

In one preferred form of the programming mode, a predetermined number of coins, (for example, 10) is run through the validator. Such coins should all of course be of the same type—country, denomination, size and so on—and should be representative of the condition of that type which are actually in circulation.

When a first coin is passed through the validator, in a preferred form of the invention, three numerical values are produced, in a manner to be described hereinafter.

For a hypothetical coin, we may say the three values are 500, 120 and 98. Those values are retained by the microprocessor.

The next coin may have values of 502, 119 and 98. Those values are also stored, such that for each of the three values there is a 'window' or range; 500 to 502, 119 to 120 and 98. As successive coins up to the predetermined are passed through the validator 10, the windows may end up as 498 to 502, 119 to 121 and 97 to 99.

Those windows of values, established by the passing of the reference coins through the validator 10, may be left as they are, but in a preferment an automatic or programmed expansion of the windows may be made, in the particular example to say 495 to 505, 118 to 122 and 96 to 100. This would be varied in accordance with knowledge, experience and/or trial, to ensure that very few genuine undamaged coins are rejected by the validator.

In an 'in use' mode, a coin is introduced into the validator 10, and the values (for example) 497, 118 and 99 are produced. Those values are compared with the stored ranges or windows of values. As each of the coin values falls within the respective stored range, that coin is accepted as a coin of the programmed value.

However, a coin having the values 540, 121 and 75, will not be accepted, but will be rejected, because its values do not full with each range. Any coin with values not falling within all of the respective ranges, will be rejected.

We will now proceed to describe in detail how an embodiment of the invention derives those values and how the 'in use' comparison with stored ranges is made.

Figure 12:
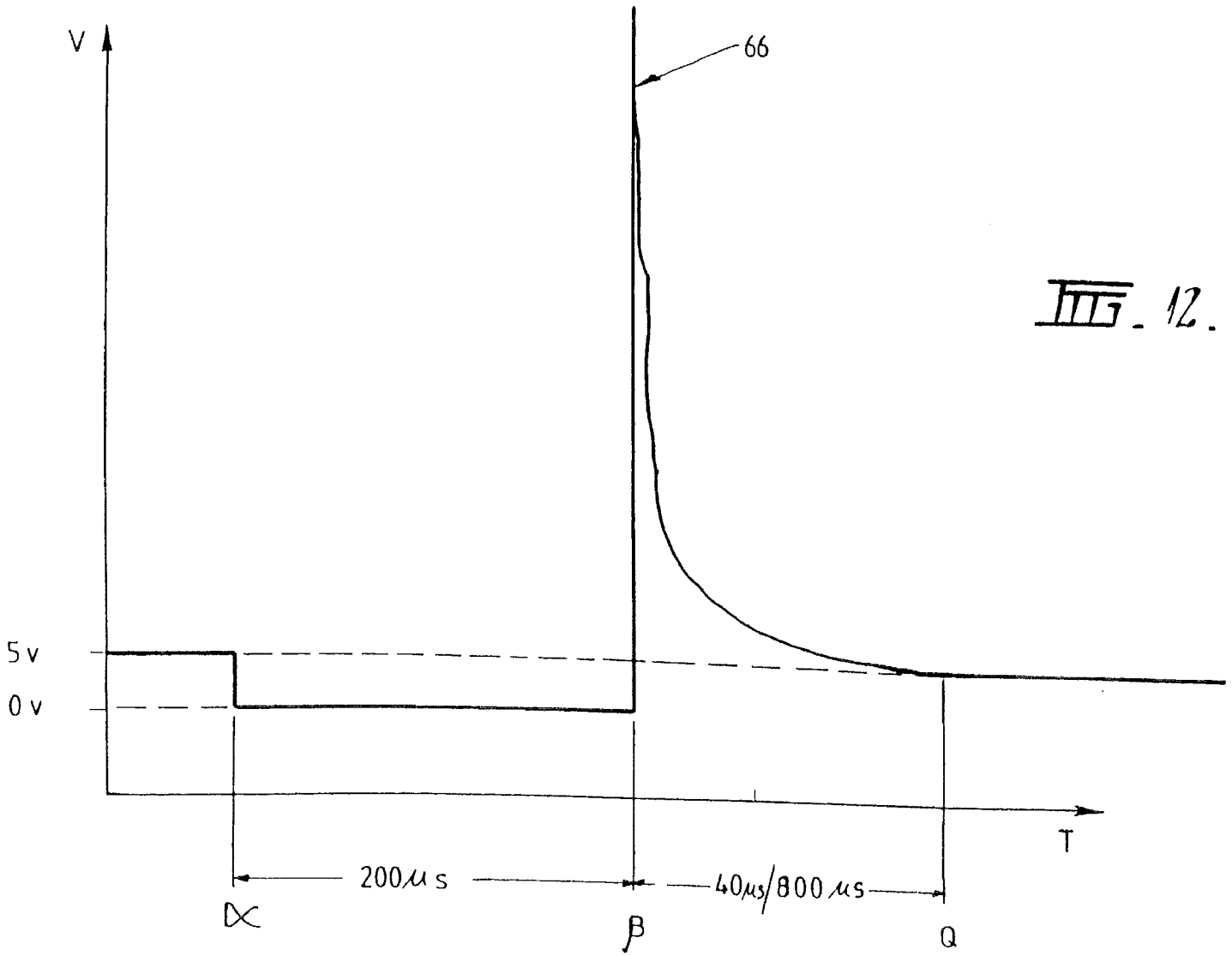
FIG. 12 is a curve showing the effect of pulsing a coin using the hardware of FIGS. 1 to 10 and/or the circuit of FIG. 11.

FIG. 12 is a graph showing what occurs when coils 40, 42 are energised and than de-energised. The graph, of voltage in the singular inductive field of coils 40 and 42, against time shows time $\alpha$ at which the coils 40, 42 are energised, and a time $\beta$ at which the coils are de-energised.

The shape of the exemplary curve of FIG. 12 is determined by such coin parameters as thickness, diameter, surface characteristics and material composition of the coin located between coils 40,42 at the time of the pulse, or coil energisation.

By way of example only, the time during which the coils 40, 42 are energised is 200 microseconds, although of course any reasonable time (consistent with a desire to rapidly validate/discriminate coins, may be used.

FIG. 12 shows a damped curve. Immediately after de-energisation, there is produced a voltage spike 66, after which the voltage decays until it reaches a quiescent state at Q. The quiescent state Q is reached when the voltage returns to the nominal voltage, in this example, 5 v.

The curve of FIG. 12 is in fact a curve produced at point A on the circuit of FIG. 11. At point B, with the involvement of a transient suppressing device (2D1 SAS), we obtain the curve of FIG. 13, which is identical to that of FIG. 12, except that it is limited (without distortion) by the transient suppressive device, such that spike 66 is reduced to a voltage limit 68.

Figure 13:
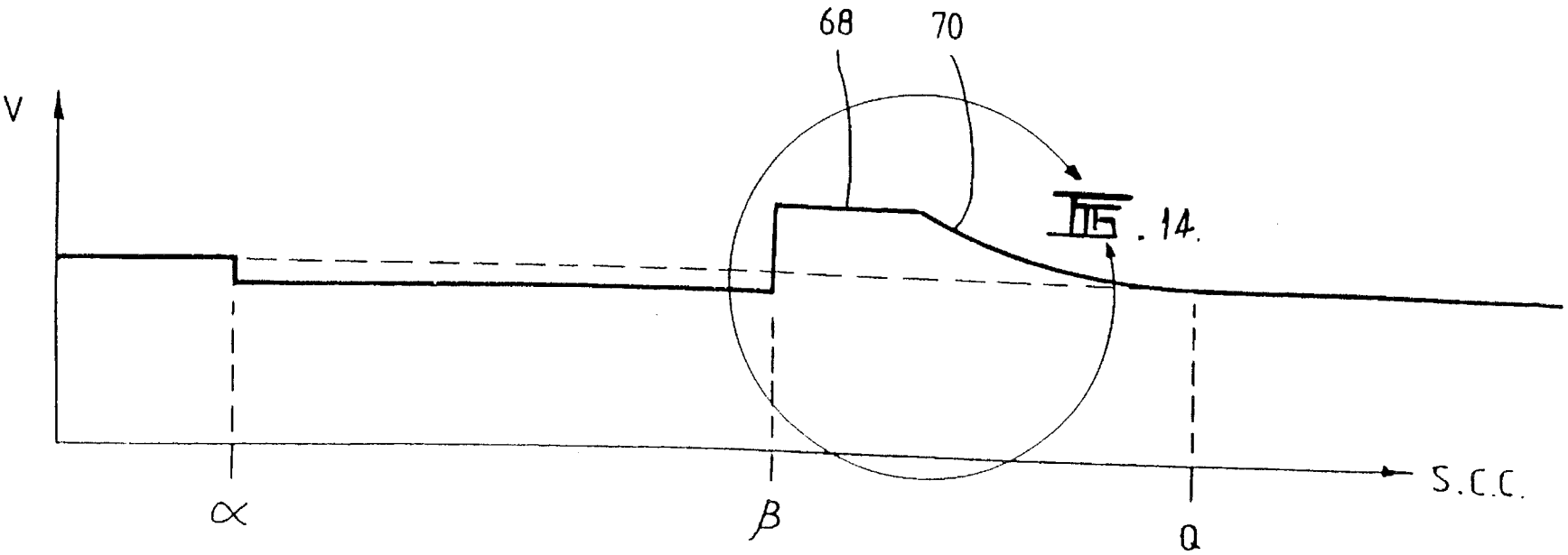
FIG. 13 is a curve showing it limited by a transil device of the circuit of FIG. 11.
Figure 14:
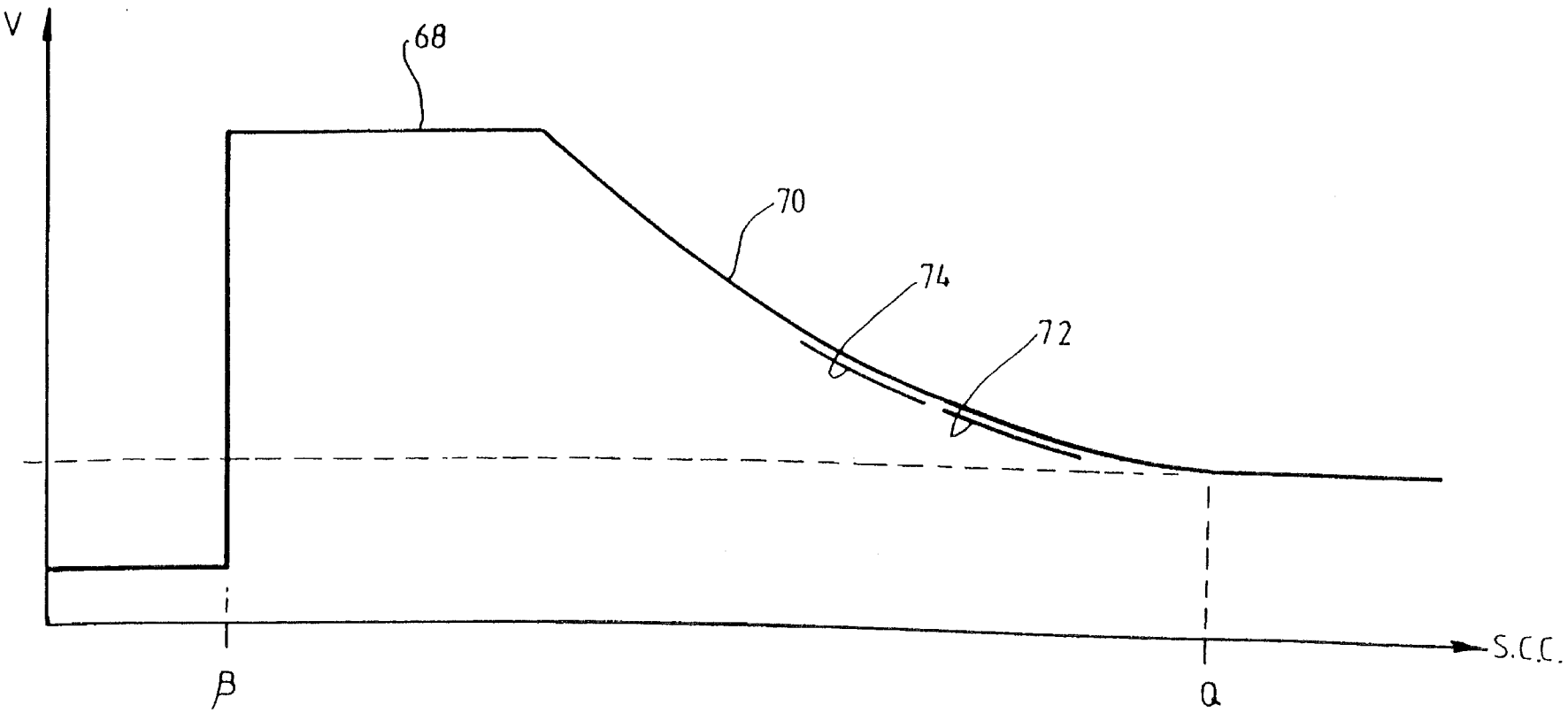
FIG. 14 is a portion of the curve of FIG. 13, enlarged for clarity.

FIG. 14 shows an enlarged view for clarity of the decay portion 70 of the curve of FIG. 13. Two parts or sections 72, 74 of the decay portion curve 70 are selected for further processing.

So far, the curves of FIGS. 12, 13 and 14 have related to a single hypothetical coin.

Figure 15:
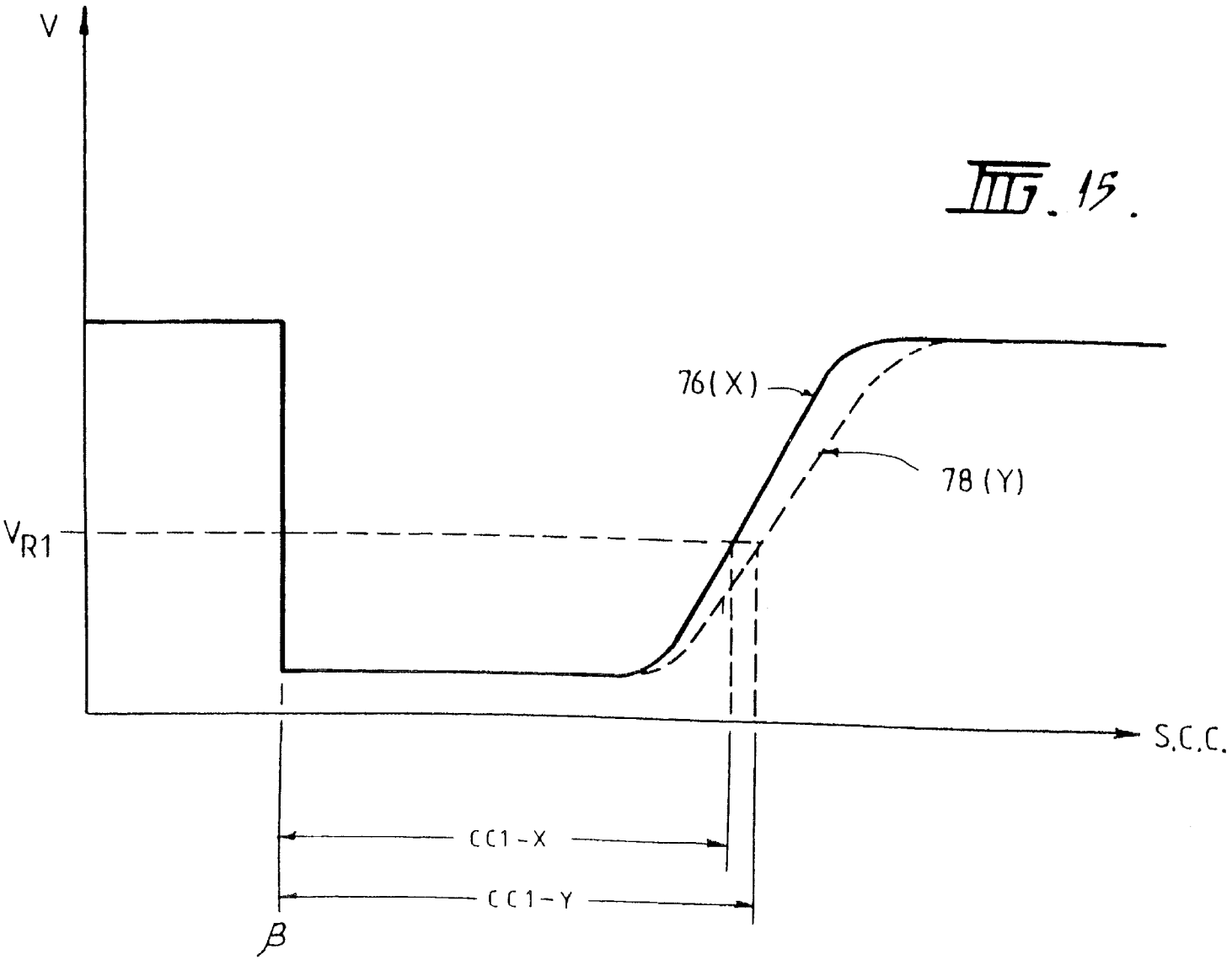
FIG. 15 is an inverted and amplified form of a part of the curve of FIG. 14.

FIG. 15 shows two curves, one (78) in broken lines and one (76) in unbroken lines, representing two different coins, X and Y (see also FIG. 5), each of which is of a different coin type. For example, curve 78 may be that of an Australian 20-cent coin, and curve 76 may be of an Australian 10-cent coin.

The curve(s) of FIG. 15 is/are that part 72 of portion 70 in FIG. 14, inverted and amplified from the FIG. 15 curve, and is represented by position C in the circuit of FIG. 11.

A reference voltage $V_{R1}$ is established, at any convenient value, and a time counted from the β position (de-energisation of coils 40,42) to the intersection of $V_{R1}$ with curve 76.

That time period, in system clock counts, is CC1.

For curve 76 (coin X) the system clock count is CC1-X. For curve 78 (coin Y), a similar time period is established as CC1-Y in system clock counts.

The numerical values of CC1-X and CC1-Y in clock counts, is one of the three numerical values established for the respective coins X and Y, as previously described.

Figure 16:
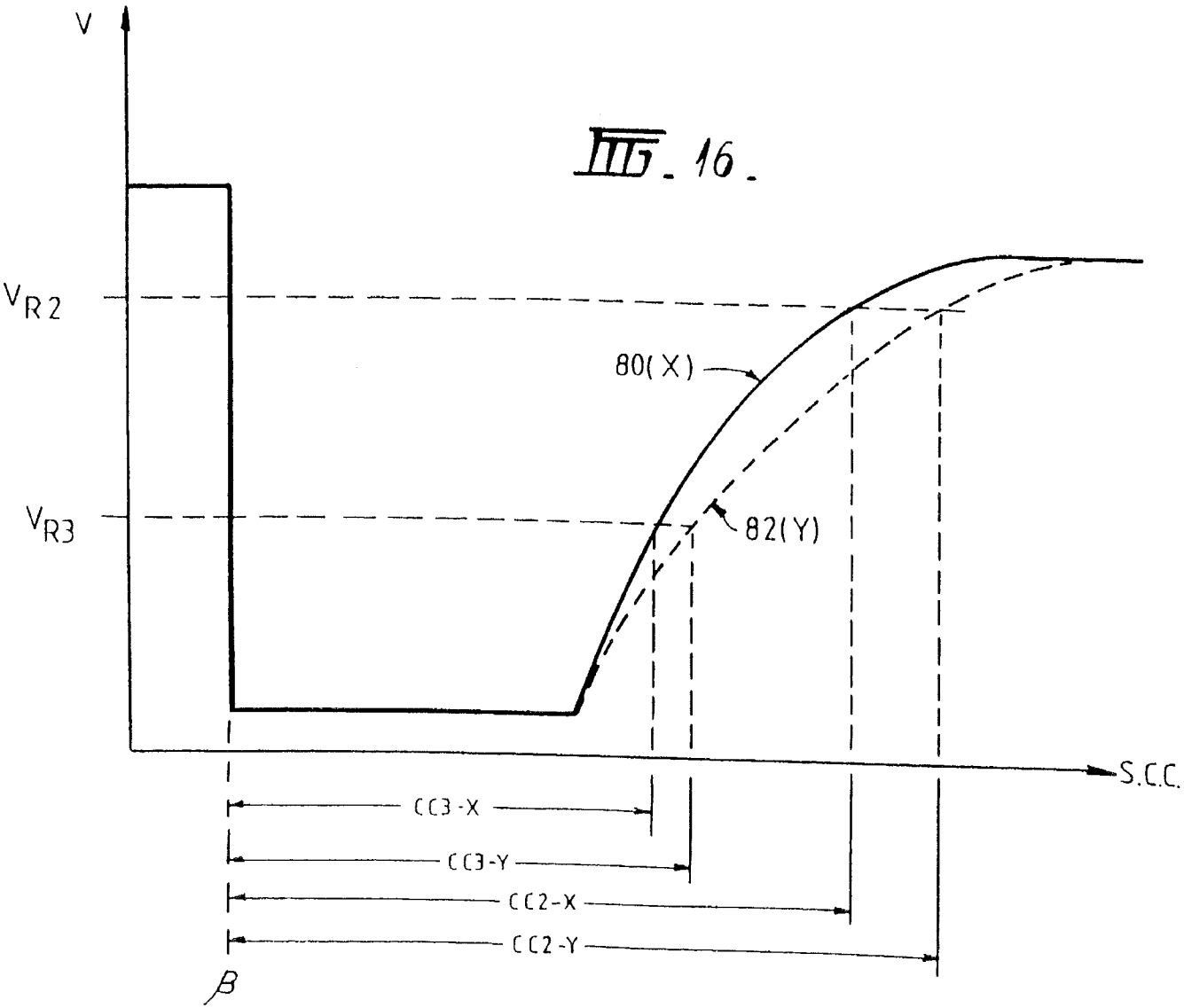
FIG. 16 is an inverted and amplified form of another part of the curve of FIG. 14.

FIG. 16 shows part 74 of curve portion 70 of FIG. 14, inverted and amplified. Curves 80 (coin X) and (in broken lines) 82 (coin Y) represent the profiles of, for example, hypothetical coins X and Y of FIG. 5.

In FIG. 16, which represents point D on the circuit of FIG. 11, two reference voltages $V_{R2}$ and $V_{R3}$ are established for each curve, a count CC2 is made between position β and the intersection of the curves with $V_{R2}$, giving counts CC2-X and CC2-Y for curves 80 and 82 respectively.

Also, a count CC3 is made for each curve from the β position to the intersection of each curve with $V_{R3}$, giving counts CC3-X and CC3-Y.

Thus, it may be said that for coin X, it has values CC1-X, CC2-X and CC3-X. In a preferred arrangement, a system clock count unit is 0.5 of a microsecond. In this example, then, the values could end up being, in clock counts:

CC1-X 497

CC2-X 118

CC3-X 99

In the programming mode of the validator 10, the CC1-X, CC2-X and CC3-X are produced by the actions of comparators U1, U2 and U3. When the appropriate reference voltage is reached in each case, the respective comparator will send a 'stop count' signal, and the number of clock counts established for CC1, CC2 and CC3 by the 'stop count' signals from comparators U1, U2 and U3 respectively, are stored in the aforementioned microprocessor.

With the passage through the validator 10 of other coins of the type of coin X, the stored CC1, CC2 and CC3 values will become ranges, 'windows' of values, as, for example, follows:

CC1 Range 495 to 505

CC2 Range 118 to 122

CC3 Range 96 to 100

If coin X were subsequently introduced into validator 10, its values (CC1-X=497, CC2-X=118, CC3-X=99) would be compared, respectively, with the ranges stored in the microprocessor. As in each case the value is within the respective range, the coin is accepted, and an acceptance signal is established.

In a preferred embodiment of the invention, ranges for twelve coin types may be stored in the microprocessor, although the apparatus and/or software may be altered to cater for any number of coin type ranges of numbers to be stored in memory for subsequent comparison.

As previously described, that acceptance signal causes validator 10 to operate to allow an accepted coin to pass down the accept channel, and provided that accept/check sensors such as 90, 92 and 94 indicate that the coin has passed in the correct direction along the coin path, the microprocessor will preferably be caused to generate outputs in respect of the coin validated, and/or in respect of the cumulative monetary values of a number of coins which have been accepted by the validator.

The programming function of the validator 10 may also be used to capture "slugs" or bogus coins, thus removing them from circulation. This is achieved by field programing the device with the type of slug concerned, but assigning a value of zero to it. In that was the slug would be 'accepted' by the validator, but no monetary would be displayed.

The validator 10 is of the embodiment of the invention may be self-compensating. The accuracy of a coin validator depends on maintaining stable electronic states. Variations in the detect and amplification circuits due to temperature, component age, and so on will affect the accuracy of the device.

This device could include means of self-compensation whereby the DC output of the operational amplifier is continuously monitored in its quiescent state. This output is automatically adjusted as required to a pre-determined level thus compensating for variations within the circuitry and maintaining the accuracy of the device. In the preferred embodiment, however, the circuit has features such that the self-compensating approach is not necessary.

It can be seen that the coin validator of this invention and/or of the described embodiments represents numerous improvements.

Firstly, single pulsing enables rapid discrimination. This is particularly useful in high-speed applications such as gambling machines and toll collection booths.

The analysis of a portion of the back EMF curve produced after pulsing enables accurate discrimination to take place.

Field programmability allows programming for new and/or different coins without having to return the validator to a workshop.

The validator body is in two basic parts for ease of accessibility and cleaning.

The coin path is designed to facilitate reproducible coin orientations in successive coins passing the detect area.

We claim:

1. A method for validating coins/tokens, including the steps of:

energizing detect coils, between which at least part of a coin/token is located, with a single pulse; extracting from at least one portion of the back EMF curve of the decaying pulse information to provide a definition of said coin/token, said or each portion of said back EMF curve being inverted and amplified; and comparing in a microprocessor said definition of said coin/token with a reference definition, to determine whether said coin/token is acceptable or unacceptable, said definition being in the form of a period of time and wherein said period of time relates to the time between a predetermined time, in relation to the de-energization of said coils, and the intersection of said back EMF curve with a reference voltage.

2. A method according to claim 1, wherein said predetermined time is that at which said coils are de-energized.

3. A method according to claim 1, wherein said period of time is represented by a number of system clock counts.

4. A method of validating a coin/token, including the steps of:

energizing detect coils, between which at least part of a coin/token is located at the time of energization;

de-energizing said coils after a predetermined time;

inverting and amplifying at least one portion of a voltage-limited back EMF curve;

obtaining a first number of system clock counts from the time between de-energization of said coils and that when the curve intersects a first reference voltage;

obtaining a second number of system clock counts from the de-energization of said coils and that when the curve intersects a second reference voltage;

obtaining a third number of system clock counts from the time between de-energization of said coils and that when the curve intersects and third reference voltage;

comparing said first number, said second number and said third number respectively with a first range of stored numbers, a second range of stored numbers and a third range of stored numbers; and producing a signal representative of the acceptance of said coin/token if said first number, said second number and said third number fall respectively within said first range, said second range and said third range of numbers.

5. A method according to claim 4, wherein a first and a second portion of the curve is inverted and amplified and wherein:

the first number of system clock counts is obtained from the time between de-energization of said coils and that when the curve intersects the first reference voltage;

the second number of system clock counts is obtained from the time between de-energization of said coils and that when the curve intersects the second reference voltage; and the third number of system clock counts is obtained from the time between de-energization of said coils and that when the curve intersects the third reference voltage.

6. A method according to claim 4 wherein the inverting and amplifying is of a curve of the decaying voltage in said coils.

7. A method of programming a coin/token validator to store reference values for one type of coin/token, including the steps of:

energizing detect coils, between which at least part of a first coin/token of a first type is located at the time of energization with a single pulse;

extracting from the back EMF of the decaying pulse information in the form of a first set of numbers, which set constitutes a definition of said first coin/token;

storing said first set of numbers;

repeating said first and second steps for a predetermined number of coins/tokens of a first type, and storing each set of numbers produced by said steps with said first set of numbers, to produce a set of ranges of numbers; and establishing the set of stored ranges of numbers obtained for all the coins/tokens of said first type as a set of ranges of numbers representative of said first type of coin/token.

8. A method according to claim 7, wherein each of said first set of numbers, second set of numbers, and set of ranges of numbers includes three numbers.

9. A method according to claim 7 or claim 8, wherein said numbers are numbers of clock counts.

10. A method according to claim 8 where said three ranges of numbers are obtained from two portions of said EMF curve.

11. A method according to claim 7, wherein said set of stored ranges of numbers is first expanded at a high end of said ranges.

12. A method according to claim 7, wherein said set of stored ranges of numbers is expanded at the low end of said ranges.

13. A method according to claim 7, wherein each of said first set of numbers, second set of numbers and set of ranges of numbers includes three ranges of numbers.

14. A coin/token validator including:

a reference path;

detect coils located on either side of said path;

detect means to detect the presence of at least part of a coin/token between said coils;

means to energize and de-energize said coils with a single pulse; and means to derive a definition of said coin/token after the period of energization, said definition being constituted by at least one number of system clock counts, derived from portions of the post de-energization decay curve of the voltage in said detect coils.

15. A coin/token validator according to claim 14, wherein there is also accept-reject means to act upon discrimination to allow said coin to move to one of a plurality of destinations.

16. A coin/token validator according to claim 15, wherein said accept-reject means includes an arm which is pivoted on a floating pivot, said arm being adapted to move between an "accept" position and a "reject" position, on receipt of the appropriate signal, said arm being moved against biasing means by solenoid means.

17. A coin/token validator according to claim 14 or claim 16 which is constituted by a first body portion and a second body portion, said body portions being hinged together, the respective interiors of said body portions defining a coin/token path.

18. A coin/token validator according to claim 17, wherein said body portions are normally biased together by spring means.

19. A coin/token validator according to any one of claims 14 or 16, wherein there is an anti-cheat feature including at least two sets of sensors detecting the passage of said coin/token, said sensors being monitored and operated such that unless the said coin/token passes the said sensors in the correct direction thus activating them in the correct sequence, then the passage of the said coin/token will sound a fraud alarm or alternatively, no transaction will be transmitted.

20. A coin/token validator according to claim 14, wherein said definition is constituted by a set of numbers of system clock counts.

* * * * *